United States Patent [19]

Frolov

[11] Patent Number: 4,957,316

[45] Date of Patent: Sep. 18, 1990

[54] ARMATURE FOR ELECTROMAGNETIC LOCK

[75] Inventor: George Frolov, Farmington, Conn.

[73] Assignee: Harrow Products, Inc., Grand Rapids, Mich.

[21] Appl. No.: 340,499

[22] Filed: Apr. 19, 1989

[51] Int. Cl.[5] ..... E05C 17/56

[52] U.S. Cl. ..... 292/251.5; 292/DIG. 64; 292/DIG. 60

[58] Field of Search ..... 292/251.5, 92, 144, 292/201, DIG. 60, DIG. 64

[56] References Cited

U.S. PATENT DOCUMENTS

| | | | |
|---|---|---|---|
| 3,533,652 | 10/1970 | Crane et al. | 292/251.5 |
| 3,781,047 | 12/1973 | Surko, Jr. | 292/251.5 |
| 3,913,958 | 10/1975 | Larime | 292/251.5 |
| 4,049,302 | 10/1977 | Andersson et al. | 292/251.5 |
| 4,439,808 | 3/1984 | Gillham | 292/144 |
| 4,652,028 | 3/1987 | Logan et al. | 292/251.5 |
| 4,696,500 | 9/1987 | Zunkel | 292/251.5 |
| 4,703,962 | 11/1987 | Kelly et al. | 292/251.5 |
| 4,861,080 | 8/1989 | Frolov | 292/251.5 |

FOREIGN PATENT DOCUMENTS

| | | | |
|---|---|---|---|
| 1070958 | 12/1959 | Fed. Rep. of Germany | 292/251.5 |
| 661733 | 11/1951 | United Kingdom | 292/251.5 |

*Primary Examiner*—Eric K. Nicholson

*Attorney, Agent, or Firm*—Chilton, Alix & Van Kirk

[57] ABSTRACT

An electromagnetic surface lock comprising an electromagnetic adapted to be mounted to a door frame and an armature adapted to be mounted to a door and attracted to the electromagnet and lock the door in the frame, said armature comprising first and second plates of magnetic flux permeable material, the plates being secured together in surface contact, a device for mounting said armature to a door and having headed portion with a socket therein and, having a shank portion adapted to be received in and secured to the door, a recess is defined in the first of the plates, and receives the headed portion, the second plate has an opening therein for receiving the shank portion whereby the headed portion is captured between the plates, and a small passage is defined through the first plate to the socket in the headed portion for receiving a turning tool whereby the headed device may secure the armature to the door, the second plate greatly increasing the rigidity of the armature.

8 Claims, 2 Drawing Sheets

PRIOR ART

ARMATURE FOR ELECTROMAGNETIC LOCK

FIELD OF THE INVENTION

This invention relates to an improved armature or strike plate for an electromagnetic surface lock.

BACKGROUND OF THE INVENTION

Electromagnetic surface locks for doors are well known and are well exemplified by FIG. 1 of the U.S. Pat. No. 4,652,028 which shows an electromagnetic mounted to the soffit of a doorway and a magnetically attractive armature mounted to the door. When the door is closed and the electromagnet is energized it will exert a substantial holding force on the magnet and lock the door.

The armature is mounted to the door by means of a mounting screw or similar fastening device and will also include guide pins extending into the door to keep the armature from being rotated and maintain it aligned with the electromagnet. It has been common practice to pass the mounting screw or bolt through the armature into the door and also to countersink a large diameter to receive the head of the bolt so that the head of the bolt will not interfere with surface contact of the armature with the electromagnet.

The counter sinking or provision of the recess for the head of the bolt and the passage of the shank of the bolt through the armature requires removal of magnetic material from the armature. This requirement decreases the rigidity of the armature and weakens the armature in the central portion thereof. This decrease in the rigidity will greatly affect the magnetic holding force.

Accordingly, the present invention provides a new and improved armature construction for an electromagnetic surface lock which increases the contact area of the armature with the electromagnet and provides increased rigidity which substantially increases the holding force.

SUMMARY OF THE INVENTION

Briefly stated, the invention in one form thereof comprises a composite armature or strike plate adapted to be mounted to the door where the armature comprises first and second plates of magnetic flux permeable material with the plate of major thickness adapted to be in flush contact with the electromagnet. A headed fastening device such as a screw or bolt is received in a small countersunk recess in the main armature plate opposite the contact surface with the electromagnet and is captured therein by a back plate which is affixed to the strike plate. The mounting screw has a socket therein for receiving a turning tool and the only passage through the strike plate is a small one adapted to receive a turning tool such as an Allen wrench. The back plate captures the head of the screw in the small recess and is fastened by a plurality of screws to the strike plate. The armature assembly also carries guide pins adapted to fit into openings in the door to prevent rotation of the armature about the mounting screw. This structure substantially increases the contacting surface of the strike plate of the armature with the electromagnet and the small amount of metal removed from the electromagnet does not substantially affect the rigidity thereof.

An object of the invention is to provide a new and improved armature structure for an electromagnetic surface lock of increased rigidity and greater holding force.

The features of the invention which are believed to be novel are particularly pointed out an distinctly claimed in the concluding portion of this specification. The invention, however, together with further objects and advantages thereof may best be appreciated by reference to the following detailed description taken in conjunction with the drawings.

DETAILED DESCRIPTION OF PREFERRED EMBODIMENT OF THE INVENTION

Figure 1:
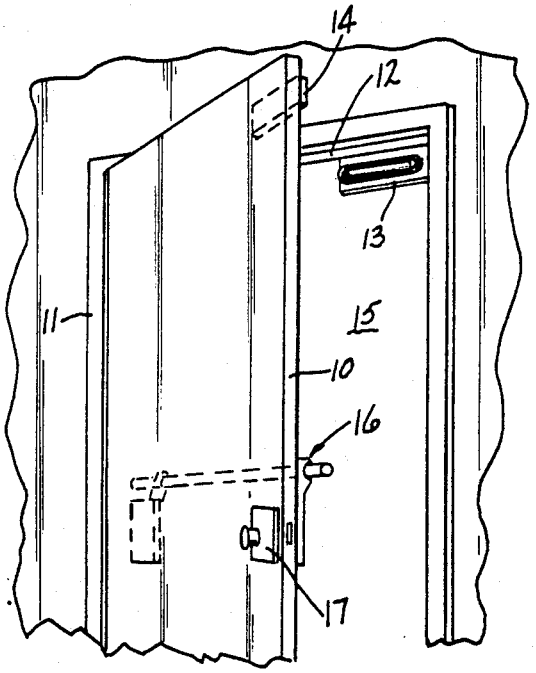
FIG. 1 is a view in perspective of a portion of a doorway and door which utilizes an electromagnetic lock.

FIG. 1 exemplifies a door 10 pivoted on its left side to a door frame 11 which includes a soffit 12. Mounted to the soffit 12 is an electromagnet 13 adapted to attract an armature 14 mounted to the door. The electromagnetic lock which includes the electromagnet 13 and the armature 14 is intended to secure the area 15 beyond door 10. The door may further include an exit device in the form of a conventional panic bar mechanism 16. Usually, the panic bar mechanism, when activated, will through appropriate switches and electrical circuitry, de-energize electromagnet 13 and permit door 10 to be swung open. The door will also include a conventional lock set 17 which in the absence of an authorized key or other identifying device such as a card will not open when the electromagnet is energized. Such devices for de-energizing the electromagnet upon authorized opening or manipulation of the lock set are well known and do not form any part of the present invention and therefore will not be further discussed.

Figure 2:
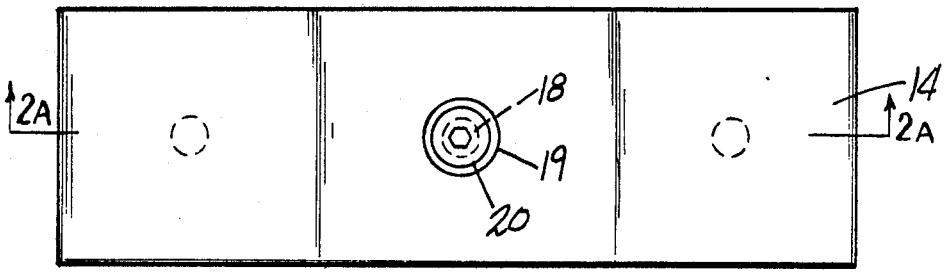
FIG. 2 is a view of the contacting surface of an armature for an electromagnetic surface lock which is presently known.
Figure 2A:
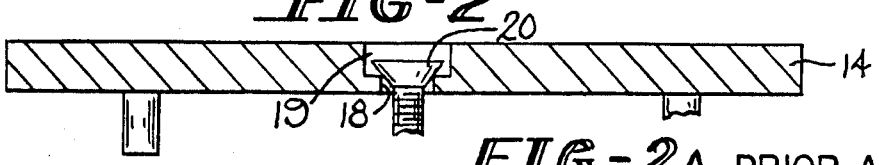
FIG-2A PRIOR ART
FIG. 2*a* is a sectional view see in plane of lines 2*a*—2*a* of FIG. 2.

FIGS. 2 and 2*a* exemplifies a prior art armature 14 seen from the contact surface thereof a section through the center thereof. The armature 14 comprises a plate of magnetically permeable material which is magnetically attracted into engagement with the electromagnet 13 and held there unless the magnetic holding force is exceeded by a force tending to open to door. Defined in the armature 14 is an aperture 18 which is counter sunk at 19 to receive the head 20 of a bolt, screw or other securing device to secure the armature to a door 10. The armature 14 also includes guide pins as hereinafter exemplified.

This removal of material from and into the contacting surface of armature 14 increases the reluctance to the magnetic flux passing through the armature and in addition lessens the rigidity of the armature in the central portion thereof.

Figure 3:
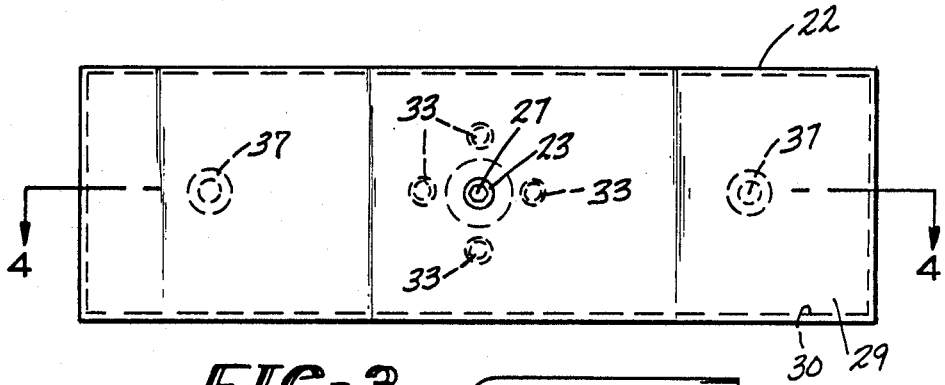
FIG. 3 is a view of the contact surface of the armature embodying the invention adapted for use with the electromagnet of FIG. 1.

Reference is now made to FIG. 3 which exemplifies an armature 22 embodying the invention shown from the electromagnetic contacting side.. This armature 22 will be mounted in the same relation to electromagnet 12 as the armature 14 in FIG. 1.

Figure 4:
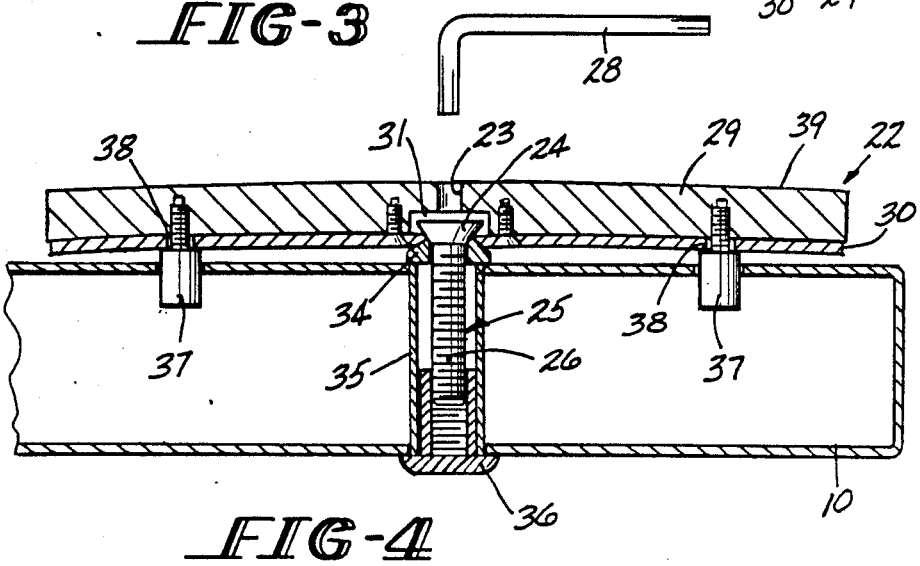
FIG. 4 is a view seen in the plane of lines 4—4 of FIG. 3.

It will be noted that in the armature 22 of FIG. 3 there is only one small opening 23 through the contacting surface which leads to the head 24 of a securing bolt 25 having a threaded shank portion 26. Defined in the head 24 of bolt 25 is a socket 27 adapted to received a turning tool, such as an Allen wrench exemplified in FIG. 4 at 28, which may pass through passage 23 to socket 27. The socket 27 may be defined to receive a bladed or Phillips head screw driver.

Armature 22 comprises a strike plate 29 and a back plate 30. A recess 31 is counter sunk in the back of strike plate 29 and it receives therein the head 24 of bolt 25. Back plate 30 is provided with an aperture which receives the shank 26 of bolt 25 therethrough and captures head 24 between recess 31 and back plate 30. A plurality of screws 33 are disposed equiangularly about passage 23 and secure back plate 30 to strike plate 29. Two of the screws are vertically on a common center line with bolt 25 and two screws are positioned on a common horizontal center line. Interposed between the head 24 of bolt 25 and the door 10 is a spacing collar 34, and a sleeve 35 extends through door 10. Door 10 is exemplified as a hollow door but may be soled or have a core material. A nut 36, is threaded onto the shank 26 of bolt 25. Armature 22 also carries a pair of guide pins 37 disposed on either side of bolt 25 which are threaded into strike plate 29 and have shoulders 38 overlying the passage through back plate 30. This construction further aids in securing back plate 30 to strike plate 29 and further rigidizes the composite structure.

This structure provides a more rigid armature for an electromagnet which greatly affects the holding force and further increases the contact area of the armature with the electromagnet thus reducing the reluctance of the armature to magnetic flux, particularly in the central portion thereof.

By requiring less material to be removed from the armature to create a countersunk cavity for the mounting bolt 20 as shown in FIG. 2, the rigidity in the former weak cross section as shown in FIG. 2 is greatly increased. The back plate 30 further acts as a portion of the armature in providing a path for magnetic flux.

Preferably the armature 22 is slightly bowed outwardly in the center along surface 39. Upon attraction to the electromagnet, the armature will flatten out and be in full surface contact. However, when the electromagnet is reenergized it will spring back to its bowed position and aid in overcoming any effects of residual magnetism which tend to hold the door in a locked position. However, as will hereinafter be pointed out, this is not the main purpose of such bowing.

The amount of bowing given to the electromagnet contact surface of the armature is very slight and may amount to an offset of 0.004–0.005 inches along an armature of seven and three-eights inches It will be noted that some space is provided between the head 24 of bolt 25 and the recess 31 in strike plate 29. This permits the armature to float a bit. When back plate 30 is attached to strike plate 29, it will conform to the curvature imparted to strike plate 29.

The described armature construction provides an armature of increased rigidity and reduced magnetic reluctance, both of which contribute to greater holding power. The slight bowing in the middle of the armature will flatten out when the electromagnet is energized and the armature is attracted thereto. For example, if the electromagnet is designed for a twenty-four volt operation the armature should flatten out and be in flush contact under the attraction force at approximately fourteen to fifteen volts. At this time the attraction force is evenly distributed across the length of the armature.

Figure 5A:
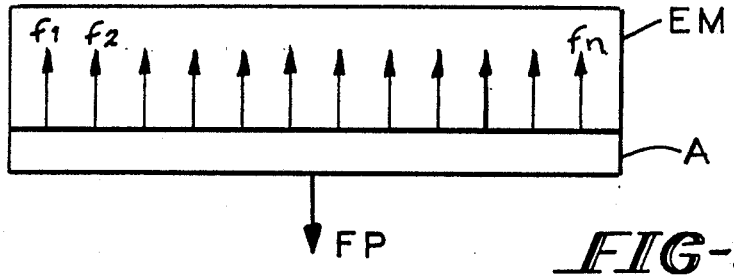
FIGS. 5*a* and 5*b* are schematic diagrams useful in explaining the features of increased rigidity of an armature embodying the invention.

Reference is now made to FIG. 5*a* which schematically exemplifies an electromagnet EM which is energized and is attracting the armature thereto. In the present invention under the attraction of the electromagnet the slightly bowed armature will become flush with the electromagnet at less than the designed operating voltage of the electromagnet lock and any pulling force FP exerted on the armature will be working against the rigid armature at the high point of the bow. The attraction force of the armature is exemplified by total small forces ($f_1, f_2 \ldots\ldots f_n$) which are representative at incremental distances along the length of the armature. Since the armature is almost absolutely rigid and a person applying a pulling force FP in an attempt to gain unauthorized entry, the total attractive force AT of the armature is:

$$AT = \sum_{i=1}^{n} f_i$$

Figure 5B:
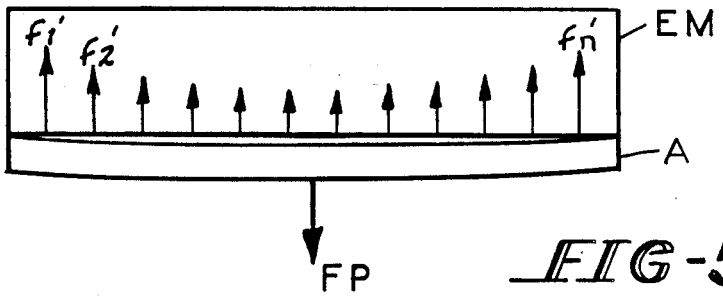

If the armature is slightly flexible in the middle as represented in FIG. 5*b* and bowed slightly concave away from the electromagnet, the sum of the incremental holding forces ($f_1', f_2' \ldots\ldots f_n'$) become less than the sum of ($f_1, f_2 \ldots\ldots f_n$) because only $f_i = f_1$ and $f_n = f_n$. The holding force or attracting force will be substantially reduced. The attracting force AT as exemplified in FIG. 5*b* may be shown by the following equation:

$$AT = \int_0^L F(f')dL$$

Where f' is the incremental holding forces along the length L of the armature from one end 0 to the other and dL is the distance between the incremental holding forces f'. Under the conditions shown in FIG. 5*b*, the following relationship occurs:

$$\int_0^L F(f')dL < \sum_{i=1}^{n} f_i$$

The foregoing relationships show the importance of maintaining the armature rigid in the central portion thereof to prevent unauthorized opening of the electromagnetic lock.

It may thus be seen that the objects of the invention set forth, as well as those made apparent from the foregoing description, are efficiently attained. While a preferred embodiment of the invention has been set forth for purposes of disclosure, modification to the disclosed embodiment of the invention, as well as other embodiments thereof, may occur to those skilled in the art. Accordingly, the appended claims are intended to cover all embodiments of the invention and modifications to the disclosed embodiment which do not depart from the spirit and scope of the invention.

What is claimed is:

1. An electromagnetic lock comprising an electromagnet adapted to be mounted to a door frame and an armature adapted to be mounted to a door and attracted to the electromagnet and lock said door in the frame, said armature comprising first and second plates of magnetic flux permeable material, means securing said plates together in surface contact, a device having a headed portion and a shank portion for mounting said armature to a door, said headed portion having a socket therein, said shank portion adapted to be received in and secured to the door, a recess in said first plate receiving the headed portion, said second plate having an opening therein for said shank portion whereby said headed portion is captured between said plates, said second plate having a generally planar portion adjacent the second plate opening and extending to partially enclose the first plate recess and said second plate engaging said first plate at said recess defining portions to structurally reinforce said armature adjacent said recess, and a small passage defined through said first plate to said socket in said headed portion for receiving a turning tool, whereby said device may secure said armature to the door.

2. The lock of claim 1 where a plurality of fastening devices secure said second plate to said first plate about said small passage.

3. The lock of claim 1 where said armature is bowed slightly convex to said electromagnet.

4. The lock of claim 3 where said armature flattens to have full surface contact with said electromagnet when said electromagnet is energized.

5. An armature for an electromagnet surface lock adapted to be mounted to a door and attracted to an electromagnet in a doorway, said armature comprising a strike plate and a back plate both of magnetic flux permeable material, said strike plate having an outer surface arranged to have full surface contact with the electromagnet, a device for mounting said armature to a door, said device having a headed portion with a socket therein and having a shank portion adapted to be received in and secured to a door, a recess in the back of said strike plate receiving the headed portion, said back plate having an opening therein for receiving said shank portion therethrough whereby said headed portion is captured between said plates, said back plate having a generally planar portion adjacent the back plate opening and extending to partially enclose the strike plate recess and said back plate engaging said strike plate at said recess defining portions to structurally reinforce said armature adjacent said recess, and a small passage defined through said strike plate to said socket in said headed portion for receiving a turning tool, whereby said headed device may secure said armature to a door.

6. The lock lock of claim 5 where a plurality of fastening devices secure said back plate to said strike plate about said small passage.

7. The lock of claim 5 where said armature is bowed slightly convex to said electromagnet.

8. The lock of claim 7 where said armature flattens to have full surface contact with said electromagnet when said electromagnet is energized.

* * * * *